US006161312A

United States Patent [19]

Yang

[11] Patent Number: 6,161,312

[45] Date of Patent: Dec. 19, 2000

[54] COLD/HEAT EXCHANGEABLE DRYING MACHINE

[76] Inventor: Pen-Ta Yang, No. 111-10, Chung-Ching Rd., Taichung, Taiwan

[21] Appl. No.: 09/323,720

[22] Filed: Jun. 1, 1999

[51] Int. Cl.[7] ..... F26B 21/00

[52] U.S. Cl. ..... 34/565; 34/77; 62/93

[58] Field of Search ..... 34/549, 656, 569, 34/575, 212, 213, 214, 215, 219, 72, 73, 74, 76, 77, 78; 62/93

[56] References Cited

U.S. PATENT DOCUMENTS

| | | | |
|---|---|---|---|
| 4,016,657 | 4/1977 | Passey | 34/92 |
| 4,050,262 | 9/1977 | Mehnert | 62/160 |
| 4,793,143 | 12/1988 | Rhodes | 62/93 |
| 5,065,586 | 11/1991 | Shapiro-Baruch | 62/93 |
| 5,245,840 | 9/1993 | Van Steenburgh, Jr. | 62/292 |
| 5,388,420 | 2/1995 | Yoshida et al. | 62/160 |
| 5,675,906 | 10/1997 | Li et al. | 34/77 |
| 5,857,344 | 1/1999 | Rosenthal | 62/93 |
| 5,983,651 | 11/1999 | Huang | 62/152 |
| 6,021,644 | 2/2000 | Ares et al. | 62/151 |

*Primary Examiner*—Pamela Wilson
*Assistant Examiner*—Michelle A Mattera
*Attorney, Agent, or Firm*—Gardere & Wynne, L.L.P.; Sanford E. Warren, Jr.

[57] ABSTRACT

A drying machine includes a first chamber, a second chamber, a first control device mounted in the first chamber and including a first main condenser, a first secondary condenser, a first main evaporator, and a first secondary evaporator, a second control device mounted in the second chamber and including a second main condenser, a second secondary condenser, a second main evaporator, and a second secondary evaporator, and a common compressor supplying a refrigerant to the first control device and to the second control device. In such a manner, when the first control device performs a cycle to increase the temperature in the first chamber, the second control device performs a cycle to decrease the temperature in the second chamber, and when the first control device performs a cycle to decrease the temperature in the first chamber, the second control device performs a cycle to increase the temperature in the second chamber.

12 Claims, 7 Drawing Sheets

COLD/HEAT EXCHANGEABLE DRYING MACHINE

CROSS-REFERENCES TO RELATED APPLICATIONS

Not Applicable.

BACKGROUND OF THE INVENTION

1. Field of the Invention

The present invention relates to a cold/heat exchangeable drying machine.

2. Description of the Related Art

A conventional drying machine in accordance with the prior art is used to dry articles such as agricultural products and the like. The drying machine usually dries the articles by either heating or cooling. However, the drying effect by either just heating or cooling the articles is not sufficient. The present invention has arisen to mitigate and/or obviate the disadvantage of the conventional drying machine.

BRIEF SUMMARY OF THE INVENTION

In accordance with one aspect of the present invention, a drying machine comprises a first chamber, a second chamber, a first control device mounted in the first chamber and including a first main condenser, a first secondary condenser, a first main evaporator, and a first secondary evaporator, a second control device mounted in the second chamber, serially connected with the first control device, and including a second main condenser, a second secondary condenser, a second main evaporator, and a second secondary evaporator, and a common compressor simultaneously supplying a refrigerant to the first control device and to the second control device.

When the first control device performs a cycle to increase the temperature in the first chamber, the second control device simultaneously performs a cycle to decrease the temperature in the second chamber, and when the first control device performs a cycle to decrease the temperature in the first chamber, the second control device simultaneously performs a cycle to increase the temperature in the second chamber.

Further benefits and advantages of the present invention will become apparent after a careful reading of the detailed description with appropriate reference to the accompanying drawings.

DETAILED DESCRIPTION OF THE INVENTION

Figure 1:
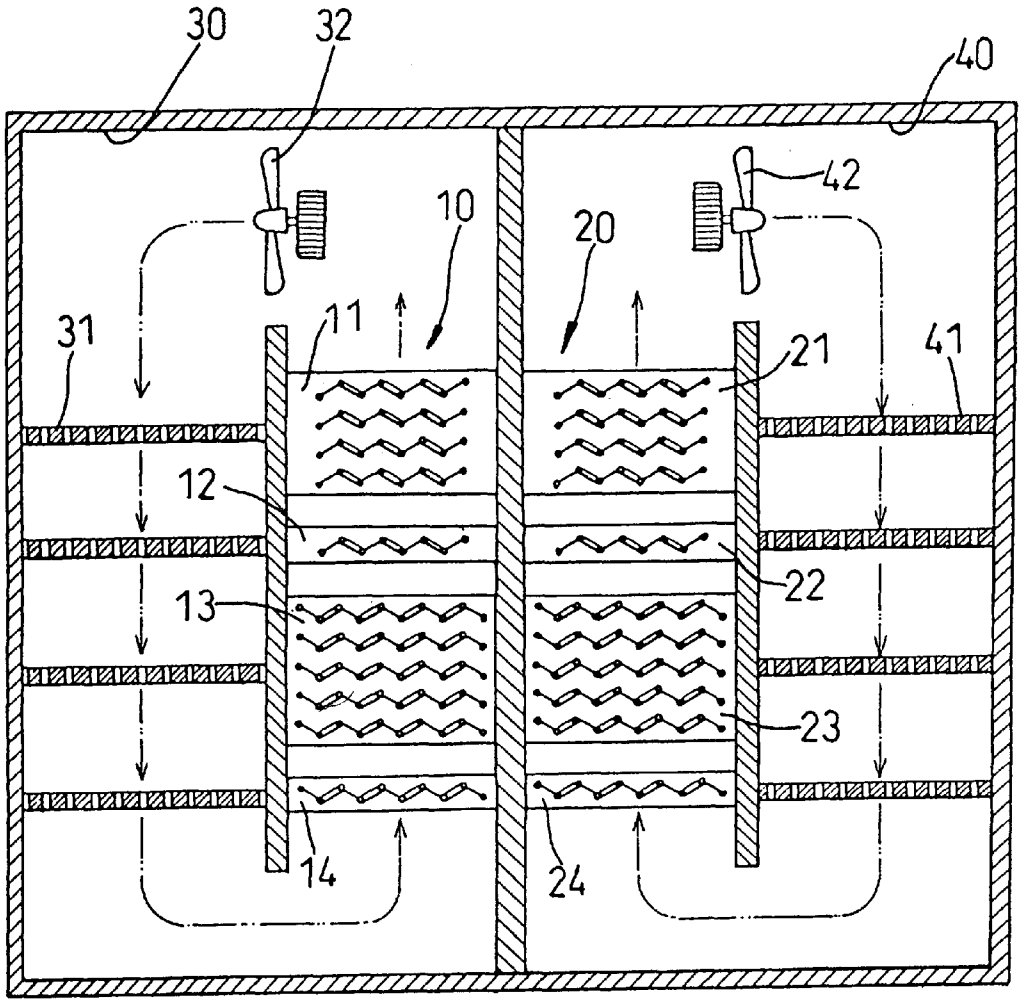
FIG. 1 is a front plan cross-sectional view of a cold/heat exchangeable drying machine in accordance with the present invention.
Figure 2:
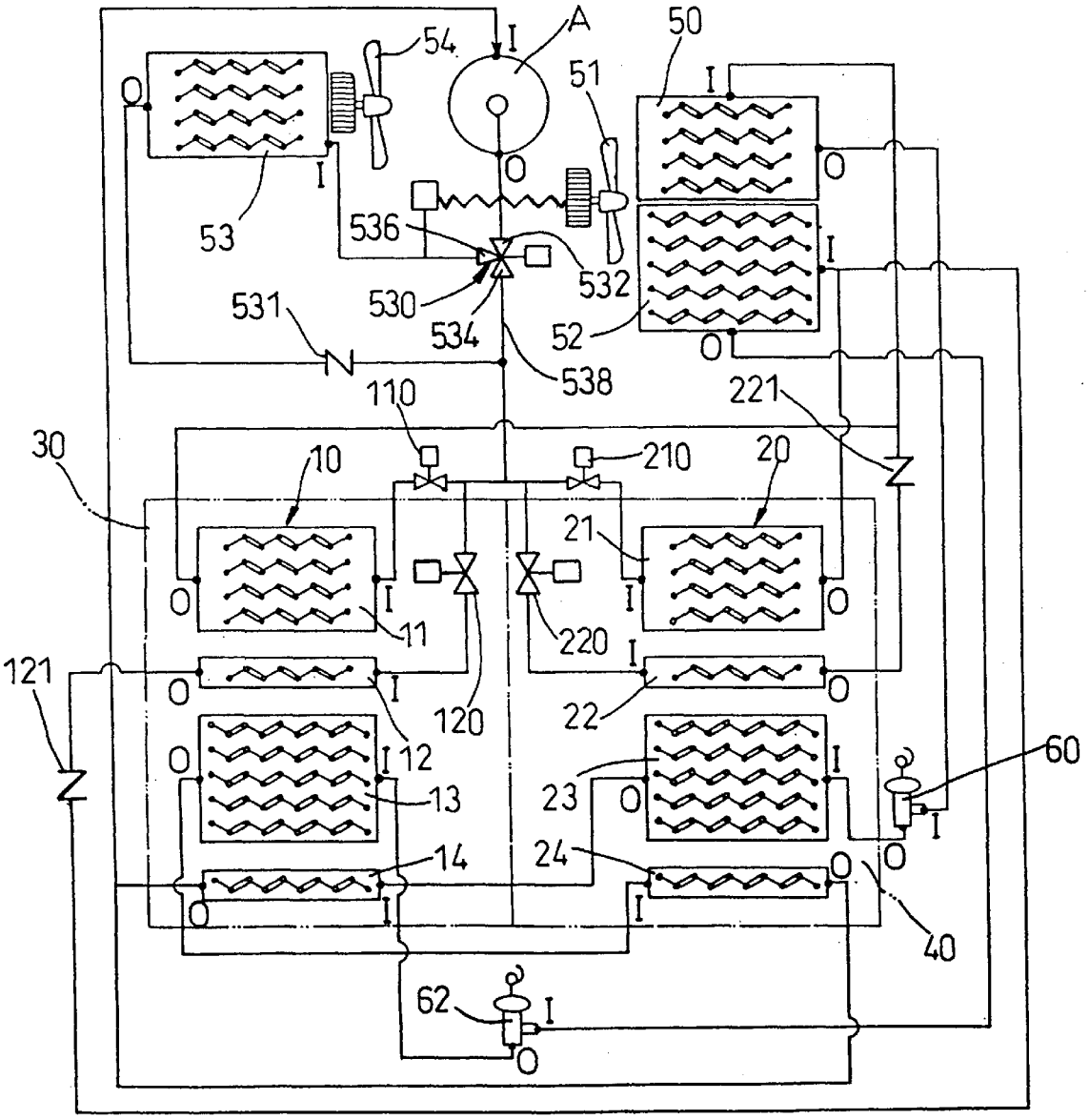
FIG. 2 is a detailed schematic diagram of the drying machine as shown in FIG. 1.
Figure 3:
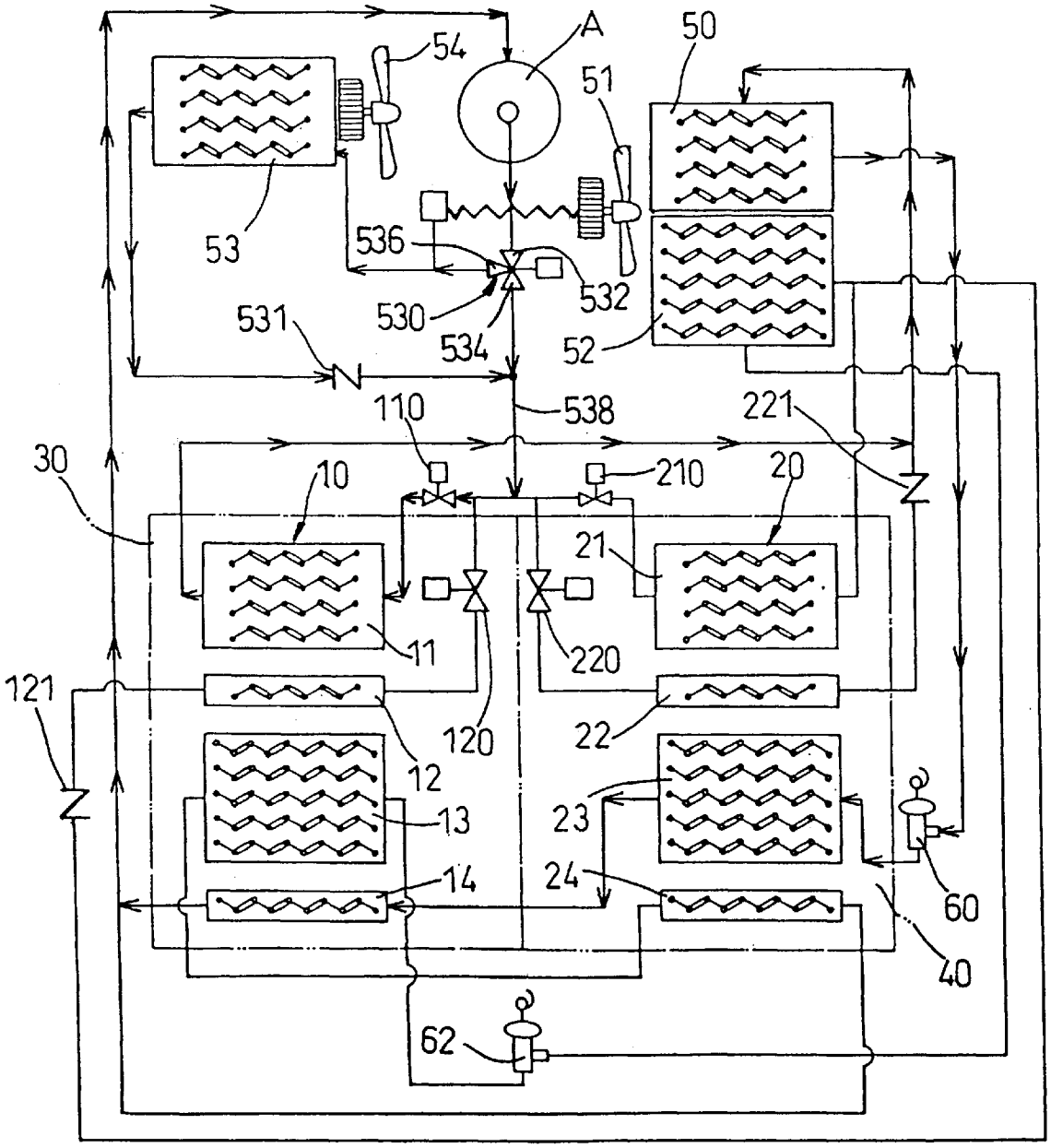
FIG. 3 is a detailed schematic diagram of the drying machine as shown in FIG. 2 in operation.

Referring to the drawings and initially to FIGS. 1–3, a cold/heat exchangeable drying machine in accordance with the present invention comprises a first chamber (30), a second chamber (40), a first control device (10) mounted in the first chamber (30) and including a first main condenser (11), a first secondary condenser (12), a first main evaporator (13), and a first secondary evaporator (14), multiple perforated first baffles (31) mounted in the first chamber (30) to support articles (not shown) thereon, a first fan (32) mounted in the first chamber (30) to force the air in the first chamber (30) to circulate through the first control device (10) and the first baffles (31), a second control device (20) mounted in the second chamber (40) and including a second main condenser (21), a second secondary condenser (22), a second main evaporator (23), and a second secondary evaporator (24), multiple perforated second baffles (41) mounted in the second chamber (40) to support articles (not shown) thereon, a second fan (42) mounted in the second chamber (40) to force the air in the second chamber (40) to circulate through the second control device (20) and the second baffles (41), and a common compressor (A) simultaneously supplying a refrigerant to flow through the first control device (10) and through the second control device (20).

When the first control device (10) performs a cycle to increase the temperature in the first chamber (30), the second control device (20) simultaneously performs a cycle to decrease the temperature in the second chamber (40), and when the first control device (10) performs a cycle to decrease the temperature in the first chamber (30), the second control device (20) simultaneously performs a cycle to increase the temperature in the second chamber (40).

The common compressor (A) has an input (I) and an output (O), the first main condenser (11) has an input (I) connecting to the output (O) of the common compressor (A) by a valve (110), the second secondary condenser (22) has an input (I) connecting to the output (O) of the common compressor (A) by a valve (220), the second main evaporator (23) has an input (I) connecting to the output (O) of an expansion valve (60) whose input (I) connects to the output (O) of the first main condenser (11) and to the output (O) of the second secondary condenser (22) via a first auxiliary condenser (50), and the first secondary evaporator (14) has an input (I) connecting to the output (O) of the second main evaporator (23), and an output (O) connecting to the input (I) of the common compressor (A).

The first auxiliary condenser (50) has an input (I) connecting to the output (O) of the first main condenser (11) and to the output (O) of the second secondary condenser (22), and an output (O) connecting to the input (I) of the expansion valve (60). A check valve (221) is mounted between the output of the second secondary condenser (22) and the input of the first auxiliary condenser (50).

The first secondary condenser (12) has an input (I) connecting to the output (O) of the common compressor (A) by a valve (120), the second main condenser (21) has an input (I) connecting to the output (O) of the common compressor (A) by a valve (210), the first main evaporator (13) has an input (I) connecting to the output (O) of an expansion valve (62) whose input (I) connects to the output (O) of the first secondary condenser (12), and to the output (O) of the second main condenser (21) via a second auxiliary condenser (52), and the second secondary evaporator (24) has an input (I) connecting to the output (O) of the first main evaporator (13), and an output (O) connecting to the input (I) of the common compressor (A).

The second auxiliary condenser (52) has an input (I) connecting to the output (O) of the first secondary condenser (12) and to the output (O) of the second main condenser (21), and an output (O) connecting to the input (I) of the expansion valve (62). A check valve (121) is mounted between the output (O) of the first secondary condenser (12) and the input (I) of the second auxiliary condenser (52).

The drying machine comprises a three way valve (530) having a first pass (532) connecting to the output (O) of the common compressor (A), a second pass (534) connecting to the valves (110; 120) of the first control device (10) and the valves (210; 220) of the second control device (20) by a pipe (538), and a third pass (536) connecting to the input (I) of a third auxiliary condenser (53) that has an output connecting to the pipe (538) via a check valve (531).

A first fan (51) dissipates heat radiated from the first auxiliary condenser (50) and the second auxiliary condenser (52), and a second fan (54) dissipates heat radiated from the third auxiliary condenser (53).

In operation, referring to FIG. 3 with reference to FIGS. 1 and 2, when the intent is to increase the temperature of the air in the first chamber (30) and to decrease the temperature of the air in the second chamber (40), the valve (110) to the first main condenser (11) is opened, and the other valves (120; 220; 210) are closed such that the refrigerant discharged from the common compressor (A) flows in the direction as shown by arrows.

The refrigerant initially releases heat at it flows through the first main condenser (11) so as to increase the temperature of the air in the first chamber (30) and heat the articles in the first chamber (30), then it flows through the first auxiliary condenser (50), the expansion valve (60), the second main evaporator (23) where it absorbs heat thereby decreasing the temperature of the air in the second chamber (40) and cools the articles in the second chamber (40), then through the first secondary evaporator (14) so as to dry the articles in the first chamber (30), and finally into the common compressor (A), thereby completing the cycle.

When the sensors (not shown) mounted in the first chamber (30) detect that the air in the first chamber (30) is overheated, the third pass (536) of the three way valve (530) is opened, and the second pass (534) is closed such that the refrigerant initially flows through the third auxiliary condenser (53) which dissipates the heat of the refrigerant such that the refrigerant through the first main condenser (11) has a lower temperature, thereby preventing the air in the first chamber (30) from being overheated.

Figure 4:
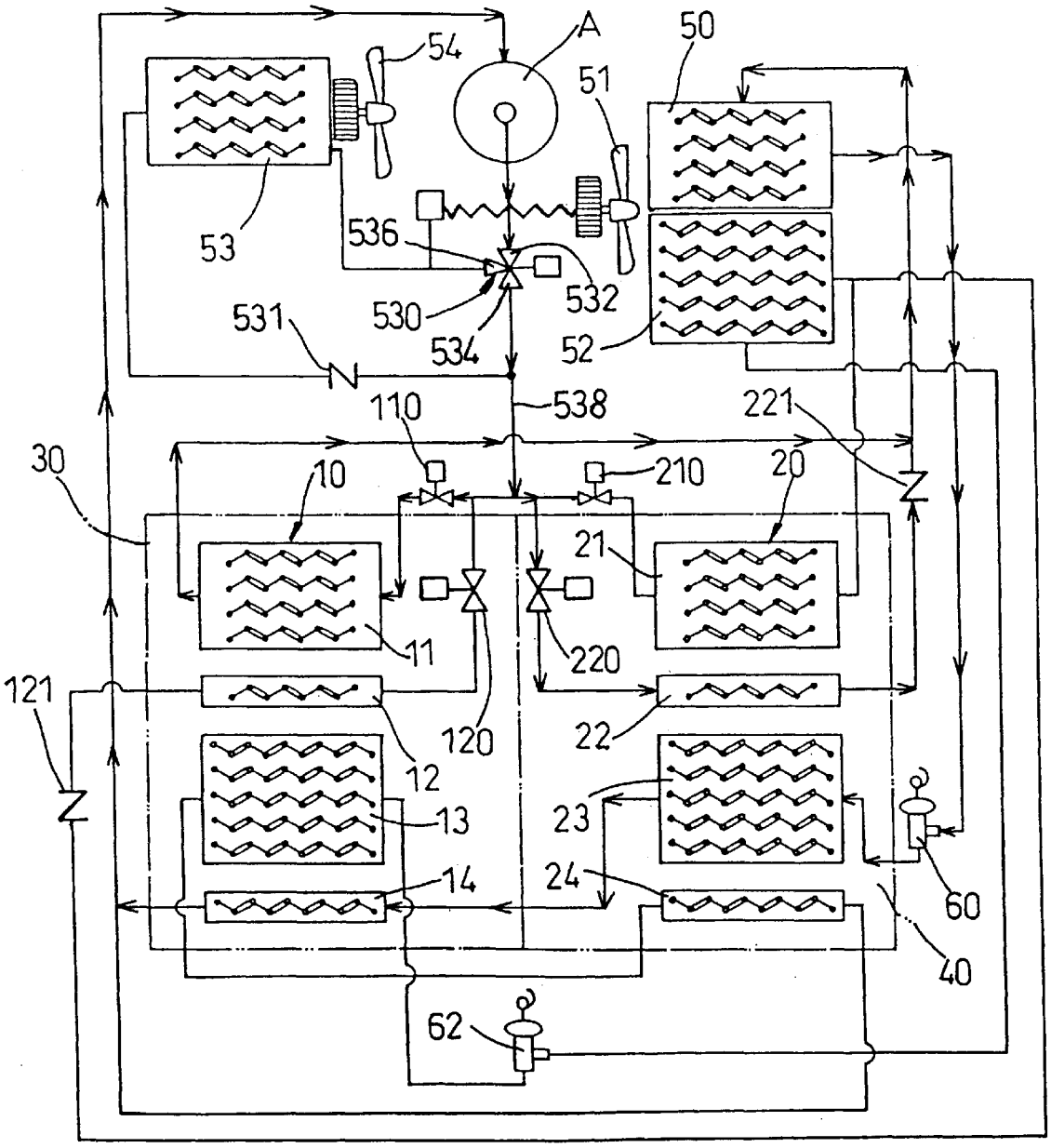
FIG. 4 is a detailed schematic diagram of the drying machine as shown in FIG. 2 in operation.

With reference to FIG. 4, when the sensors (not shown) mounted in the second chamber (40) detect that the air in the second chamber (40) is too cool, the valve (220) to the second secondary condenser (22) is opened so as to slightly increase the temperature of the air in the second chamber (40), thereby preventing the air in the second chamber (40) from being overcooled.

Figure 5:
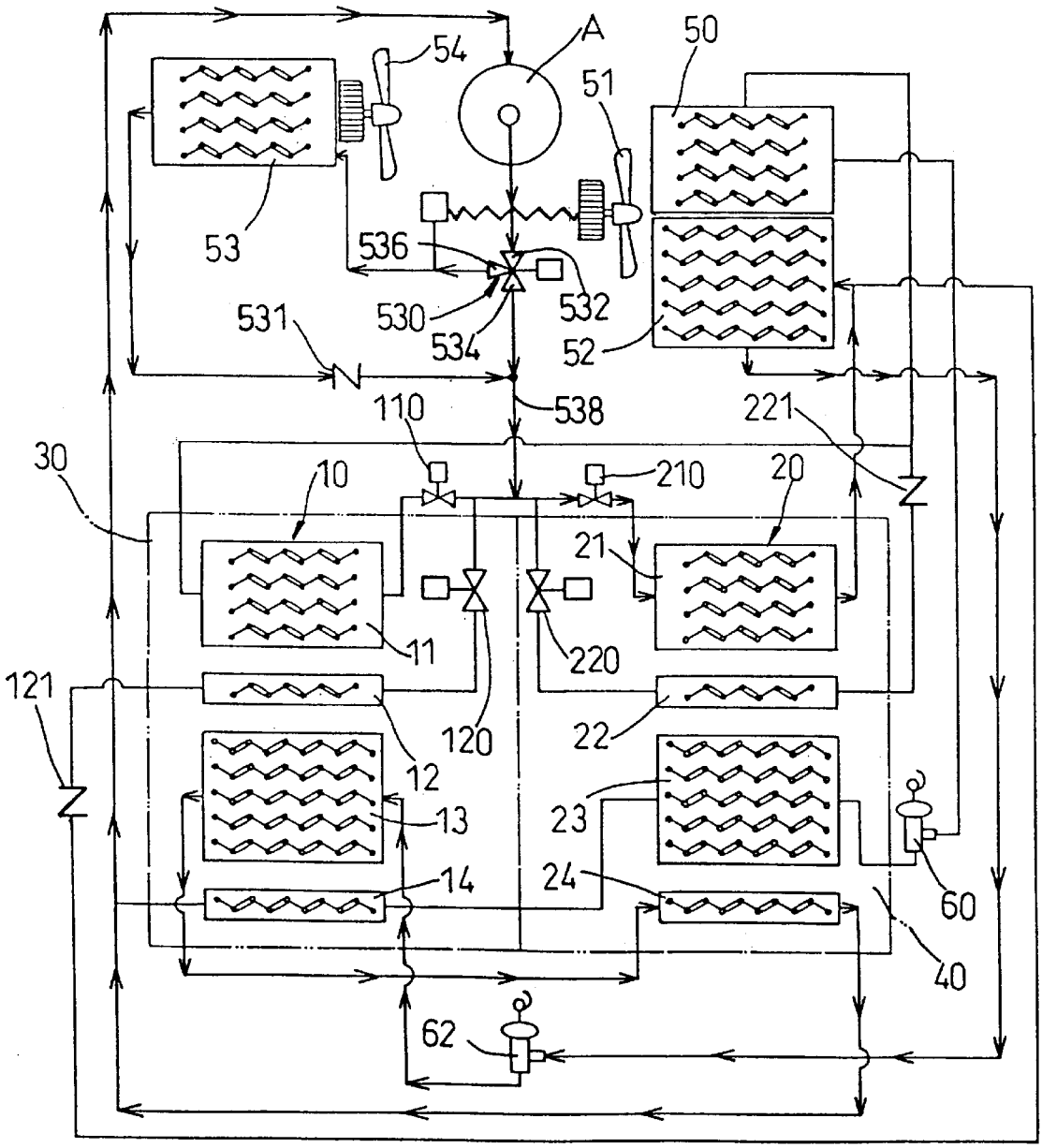
FIG. 5 is a detailed schematic diagram of the drying machine as shown in FIG. 2 in operation.

Referring to FIG. 5 with reference to FIGS. 1 and 2, when the intent is to decrease the temperature of the air in the first chamber (30) and to increase the temperature of the air in the second chamber (40), the valve (210) to the second main condenser (21) is opened, and the other valves (110; 120; 220) are closed such that the refrigerant contained in the common compressor (A) is able to flow in the direction as shown by arrows.

The refrigerant initially flows through the second main condenser (21) so as to increase the temperature of the air in the second chamber (40) to heat the articles in the second chamber (40), then through the second auxiliary condenser (52), the expansion valve (62), the first main evaporator (13) so as to decrease the temperature of the air in the first chamber (30) to cool the articles in the first chamber (30), then through the second secondary evaporator (24) to dry the articles in the second chamber (40), and finally into the common compressor (A), thereby completing the cycle.

When the sensors (not shown) mounted in the second chamber (40) detect that the air in the second chamber (40) is too hot, the third pass (536) of the three way valve (530) is opened, and the second pass (534) is closed such that the refrigerant initially flows through the third auxiliary condenser (53) which dissipates the heat of the refrigerant such that the refrigerant through the second main condenser (21) is at a lower temperature, thereby preventing the air in the second chamber (40) from being overheated.

Figure 6:
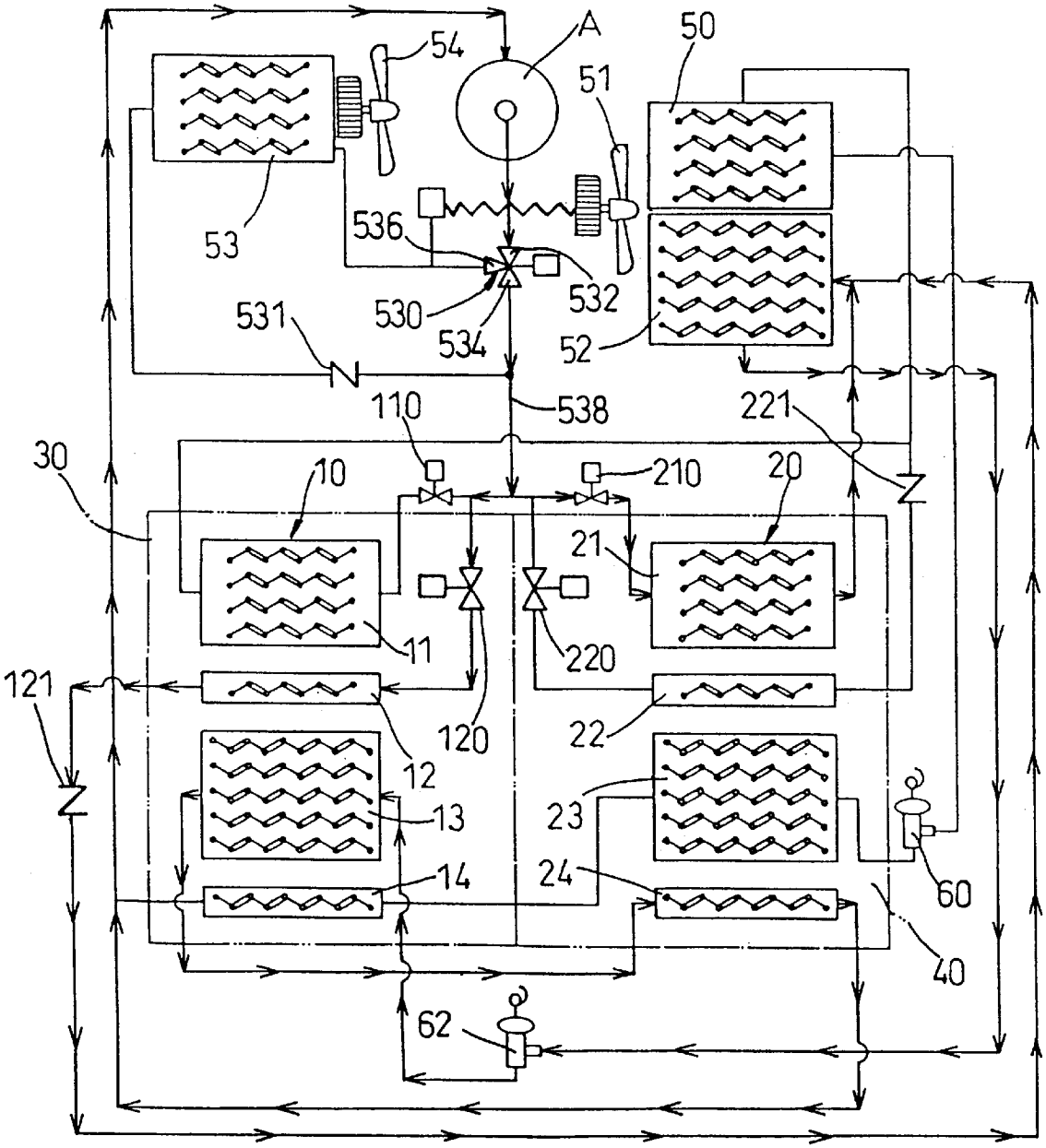
FIG. 6 is a detailed schematic diagram of the drying machine as shown in FIG. 2 in operation.

With reference to FIG. 6, when the sensors (not shown) mounted in the first chamber (30) detect that the air in the first chamber (30) is too cool, the valve (120) to the first secondary condenser (12) is opened so as to slightly increase the temperature of the air in the first chamber (30), thereby preventing the air in the first chamber (30) from being overcooled.

Figure 7:
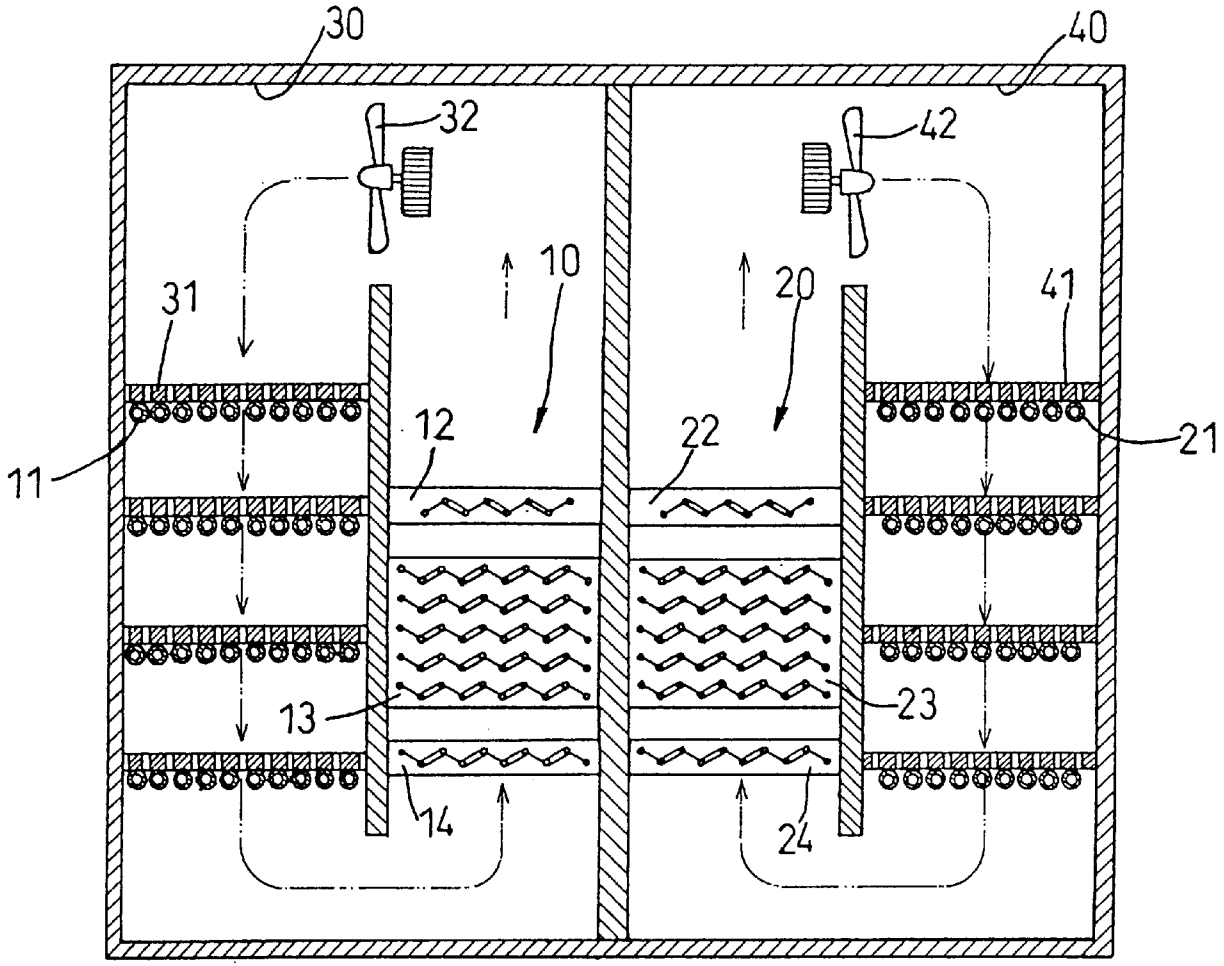
FIG. 7 is a front plan cross-sectional view of a cold/heat exchangeable drying machine in accordance with another embodiment of the present invention.

Referring to FIG. 7, the first main condenser (11) is mounted under the first baffles (31) so as to directly heat the articles supported on the first baffles (31), and the second main condenser (21) is mounted under the second baffles (41) so as to directly heat the articles supported on the second baffles (41).

It should be clear to those skilled in the art that further embodiments may be made without departing from the scope of the present invention.

What is claimed is:

1. A drying machine comprising:

a first chamber (30);

a second chamber (40);

a first control device (10) mounted in said first chamber (30) and including a first main condenser (11), a first secondary condenser (12), a first main evaporator (13), and a first secondary evaporator (14);

a second control device (20) mounted in said second chamber (40) and including a second main condenser (21), a second secondary condenser (22), a second main evaporator (23), and a second secondary evaporator (24), said second control device (20) serially connected with said first control device (10); and a common compressor (A) simultaneously supplying refrigerant to said first control device (10) and to said second control device (20);

whereby, when said first control device (10) performs a cycle to increase the temperature in said first chamber (30), said second control device (20) simultaneously performs a cycle to decrease the temperature in said second chamber (40), and when said first control device (10) performs a cycle to decrease the temperature in said first chamber (30), said second control device (20) simultaneously performs a cycle to increase the temperature in said second chamber (40).

2. The drying machine in accordance with claim 1, wherein said common compressor (A) has an input (I) and an output (O), said first main condenser (11) has an input (I) and an output (O), said input (I) connecting to said output (O) of said common compressor (A), said second secondary condenser (22) has an input (I) and an output (O), said input (I) connecting to said output (O) of said common compressor (A), said second main evaporator (23) has an input (I)

and an output (O), said input (I) connecting to said output (O) of said first main condenser (11) and to said output (O) of said second secondary condenser (22), and said first secondary evaporator (14) has an input (I) connecting to said output (O) of said second main evaporator (23), and an output (O) connecting to said input (I) of said common compressor (A).

3. The drying machine in accordance with claim 2, further comprising an auxiliary condenser (50) having an input (I) connecting to said output (O) of said first main condenser (11) and to said output of said second secondary condenser (22), and an output (O) connecting to said input (I) of said second main evaporator (23).

4. The drying machine in accordance with claim 3, further comprising a check valve (221) mounted between said output (O) of said second secondary condenser (22) and said input (I) of said auxiliary condenser (50).

5. The drying machine in accordance with claim 2, wherein said first secondary condenser (12) has an input (I) and an output (O), said input (I) connecting to said output (O) of said common compressor (A), said second main condenser (21) has an input (I) and an output (O), said input (I) connecting to said output (O) of said common compressor (A), said first main evaporator (13) has an input (I) and an output (O), said input (I) connecting to said output (O) of said first secondary condenser (12), and to said output (O) of said second main condenser (21), and said second secondary evaporator (24) has an input (I) connecting to said output (O) of said first main evaporator (13), and an output (O) connecting to said input (I) of said common compressor (A).

6. The drying machine in accordance with claim 5, further comprising an auxiliary condenser (52) having an input (I) connecting to said output (O) of said first secondary condenser (12) and to said output (I) of said second main condenser (21), and an output (O) connecting to said input (I) of said first main evaporator (13).

7. The drying machine in accordance with claim 6, further comprising a check valve (121) mounted between said output (O) of said first secondary condenser (12) and said input (I) of said auxiliary condenser (52).

8. The drying machine in accordance with claim 2, further comprising a three way valve (530) having a first pass (532) connecting to said output (O) of said common compressor (A), a second pass (534) connecting to said first control device (10) and said second control device (20), and a third pass (536).

9. The drying machine in accordance with claim 8, further comprising a pipe (538) having a first end connecting to said second pass (534) of said three way valve (530), and a second end connecting to said first control device (10) and said second control device (20), and an auxiliary condenser (53) having an input (I) connecting to said third pass (536) of said three way valve (530), and an output (O) connecting to said pipe (538).

10. The drying machine in accordance with claim 9, further comprising a check valve (531) mounted between said output (O) of said auxiliary condenser (53) and said pipe (538).

11. The drying machine in accordance with claim 1, further comprising multiple perforated baffles (31) mounted in said first chamber (30), wherein said first main condenser (11) is mounted under said baffles (31).

12. The drying machine in accordance with claim 1, further comprising multiple perforated baffles (41) mounted in said second chamber (40), wherein said second main condenser (21) is mounted under said baffles (41).

* * * * *